US008317194B2

(12) United States Patent
Werner et al.

(10) Patent No.: US 8,317,194 B2
(45) Date of Patent: Nov. 27, 2012

(54) METHOD AND DEVICE FOR GUIDING VALUE DOCUMENTS

(75) Inventors: Frank Werner, Munich (DE); Hans Lochbihler, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 13/133,240

(22) PCT Filed: Dec. 9, 2009

(86) PCT No.: PCT/EP2009/066736
§ 371 (c)(1),
(2), (4) Date: Jun. 7, 2011

(87) PCT Pub. No.: WO2010/066793
PCT Pub. Date: Jun. 17, 2010

(65) Prior Publication Data

US 2011/0233847 A1 Sep. 29, 2011

(30) Foreign Application Priority Data

Dec. 10, 2008 (DE) ..... 10 2008 061 506

(51) Int. Cl.
*B65G 53/00* (2006.01)

(52) U.S. Cl. ..... 271/264; 406/88

(58) Field of Classification Search ..... 271/195, 271/276, 264; 406/86, 88, 92; 226/97.1, 226/97.3, 97.4; 209/534
See application file for complete search history.

(56) References Cited

U.S. PATENT DOCUMENTS

| | | | | |
|---|---|---|---|---|
| 3,549,070 | A * | 12/1970 | Downham et al. | 242/615.11 |
| 5,951,006 | A * | 9/1999 | Biegelsen et al. | 271/195 |
| 7,121,201 | B2 | 10/2006 | Landskron et al. | |
| 8,087,669 | B2 * | 1/2012 | Terashima | 271/264 |
| 8,088,255 | B2 * | 1/2012 | Alev et al. | 162/263 |
| 8,092,143 | B2 * | 1/2012 | Yang et al. | 414/676 |
| 2003/0075293 | A1 * | 4/2003 | Moeller et al. | 162/193 |
| 2009/0274523 | A1 * | 11/2009 | Li et al. | 406/4 |

FOREIGN PATENT DOCUMENTS

| | | | |
|---|---|---|---|
| DE | 69910665 | T2 | 2/2004 |
| DE | 102008010984 | | 9/2008 |
| DE | 102007020996 | A1 | 11/2008 |
| EP | 0879780 | | 11/1998 |
| EP | 0960845 | | 1/1999 |
| EP | 1008542 | | 6/2000 |
| EP | 1411010 | | 4/2004 |
| JP | 06321395 | A | 11/1994 |

OTHER PUBLICATIONS

International Search of Report for PCT/EP2009/066736, Mar. 12, 2010.
Search Report of German Patent and Trademark Office regarding DE 102008061506.4, Aug. 18, 2009.

* cited by examiner

*Primary Examiner* — Jeremy R Severson
(74) *Attorney, Agent, or Firm* — Bacon & Thomas, PLLC

(57) ABSTRACT

There is described an apparatus for guiding a value document along a portion of a transport path in a specified transport direction, having a film forming device which is configured for respectively forming on mutually opposing sides of the transport path portion a film of gas flowing in the transport direction, the film extending at least over the total width of the transport path portion and thus the total width of value documents transported along the transport path, so that the value documents are guided between the gas films.

10 Claims, 3 Drawing Sheets

METHOD AND DEVICE FOR GUIDING VALUE DOCUMENTS

BACKGROUND OF THE INVENTION

1. Field of the Invention

The present invention relates to a method and an apparatus for guiding value documents.

2. Related Art

Value documents are understood in this connection to be sheet-shaped objects that represent for example a monetary value or an authorization and hence should not be producible arbitrarily by unauthorized persons. Hence, they have features that are not easily produced, in particular copied, whose presence is an indication of authenticity, i.e. production by an authorized body. Important examples of such value documents are coupons, vouchers, checks and in particular bank notes.

Such value documents, in particular bank notes, are frequently checked by machine for authenticity and/or other properties, for example their state. Upon such a check the value documents, depending on the type of the value document processing apparatus employed for this purpose, can be transported in singled form at very high speed along a transport path on which sensors for checking value documents are arranged. For transport there are normally employed transport belts between which the value documents are clamped during transport. However, in particular for double-sided checking of value documents and/or for analyzing transmission properties it would be desirable to be able to guide the value documents without belts at least for certain stretches. A transport without belts has the disadvantage, however, that the value documents then move on the transport path only due to their inertia, so that disturbances can occur, for example through flutter motions of the value documents.

Such flutter motions can in principle also occur and impair the analysis of properties of the value documents upon belt transport. Flutter motions can further lead to value documents during transport touching the surfaces of parts on the transport path, for example sensor windows, which can result in wear thereof.

BRIEF SUMMARY OF THE INVENTION

The present invention is hence based on the object of stating a method by means of which value documents can be guided, and of providing a corresponding apparatus.

This object is achieved by a method for guiding value documents transported in a specified transport direction along a portion of a transport path wherein there is respectively formed on mutually opposing sides of the transport path portion a film of gas flowing in the transport direction, said film extending at least over the width of the transport path portion and thus the width of value documents transported along the transport path, so that the value documents are guided between the gas films.

The object is further achieved by an apparatus for guiding a value document along a portion of a transport path in a specified transport direction, having a film forming device which is configured for respectively forming on mutually opposing sides of the transport path portion a film of gas flowing in the transport direction, said film extending at least over the width of the transport path portion and thus the total width of value documents transported along the transport path, so that the value documents are guided between the gas films.

For guiding value documents there are thus employed the two gas films between which the value document is guided during transport, Gas will be understood within the meaning of the invention to be any gaseous medium, which can consist of only one substance but normally comprises a mixture of substances. In particular, gas will also be understood to be air including air moisture contained therein.

A gas film will be understood here to be, not gas blown arbitrarily into the area of the transport path portion out of a nozzle, but rather a planar gas flow in which the gas flows in the transport direction of the value documents with at least one velocity component. Preferably, the velocity field of the gas flow, projected into the plane of the transport path, extends substantially, i.e. up to less than 5° , parallel to the transport direction or moving direction of the value documents. The plane of the transport path will for a straight transport, extend along the transport direction and parallel with the surface area of the value documents in the desired position in the transport path, and for a transport along a curved transport path, will extend along a tangent plane.

Particularly preferably, the gas flow in the area of the portion is substantially, i.e. up to edge areas with a width of less than 1 cm, laminar.

Further, the gas film extends over the width of the transport path portion, which is preferably wider than value documents of specified types for whose guidance the apparatus is configured. The width will be understood here to be the extension of the value document perpendicular to the transport direction, i.e. the smaller of the sides upon longitudinal transport of value documents, and the longer of the two sides upon transverse transport. The gas films preferably extend over the total width of the transport path portion.

The two gas films, on the one hand, suppress at least partly a motion of the value document in a direction orthogonal to the gas films or the plane of the value document, in particular since they extend over the width of the transport path portion, preferably the total width of the transport path portion. This effect allows a fluttering of the value documents upon transport to be reduced, in particular upon a transport of a value document with transport belts or transport bands. Particularly preferably, the guidance is effected in the portion solely by means of the apparatus, so that a transport without belts, bands and/or rollers is made possible.

Through the direction of the gas flow in the transport direction, on the other hand, a slowing down of the value documents through air resistance upon beltless transport is reduced.

For forming the gas flows, the film forming device can have in particular a gas feeding device and gas outlet openings through which gas from the gas feeding device is blown out. As a gas feeding device there can be used for example, in particular upon use of air as a gas, a corresponding pump or, in the case of other gases, a pressurized gas tank. The formation of the gas films from the gas can fundamentally be effected arbitrarily, insofar as their properties are obtained. In particular, at least one of the films can be formed by gas being blown out of several gas outlet openings which are so configured and arranged that the flows of gas exiting therefrom converge and form the gas film. However, it is preferred, in the apparatus, that the film forming device has gas outlet openings through which the gas is blown out for forming the films and which are configured in a slot shape extending perpendicular to the transport direction over the width of the transport path portion. This configuration not only simplifies the gas supply, but also facilitates the formation of the gas films over the width of the transport path portion. The slot-shaped gas outlet opening for one gas film extends with its greatest extension, i.e. with its longitudinal extension, in a direction perpendicular to the transport direction.

To obtain a guidance of the value documents that is as uniform as possible, the gas films are preferably so formed that their velocities averaged over the surface area of the films differ by less than 5% and their thicknesses by less than 10%. For this purpose, the film forming device of the apparatus is preferably configured suitably.

The gas films can be formed especially well by at least one of the gas films being formed as a gas film attached to a directing surface. Preferably, both gas films are formed as gas films attached to corresponding directing surfaces. In the apparatus, the film forming device can have for this purpose preferably two mutually opposing directing surfaces between which the transport path is located, and gas outlet openings through which the gas can be blown out, so that the films are formed as films attached to the directing surfaces. The gas outlet openings can be configured here as described in the preceding paragraph and in particular respectively in a slot shape extending perpendicular to the transport direction over the width of the transport path portion. Particularly preferably, the gas outlet openings and the directing surfaces are configured identically, so that the two gas films have if possible the same properties when the gas outlet openings are supplied with gas in the same way. The directing surfaces can be formed here by a surface portion of at least one directing element; in particular they can also be formed by surfaces of several elements.

Gas films especially well attached to the directing surface can be obtained by the gas, for forming at least one of the gas films, being blown out of a gas outlet opening that is arranged outside the transport path, and the blown-out gas being diverted in the transport direction while being attached to an arched portion of the directing surface. Preferably, for forming both gas films, gas is blown out of a respective gas outlet opening that is respectively arranged outside the transport path, and the respective blown-out gas is diverted in the transport direction while being attached to an arched portion of the respective directing surface. in the apparatus, the gas outlet openings are for this purpose preferably arranged outside the transport path, and the directing surfaces have arched portions attached to which the gas is diverted from the gas outlet openings in the transport direction. The directing surfaces can then in particular have, besides the arched portions, mutually parallel guidance directing surface portions between which the value documents are guided. Particularly preferably, the gas outlet openings are configured in a slot shape here, too, as described above. The arch of the directing surface can be given in particular by the directing surface being curved in a plane parallel to the transport direction and orthogonal to the plane of the value documents or of the transport path, the curvature being identical in the direction perpendicular to the transport direction in the plane of the transport path. Preferably, in mutually coordinated fashion the configuration of the gas outlet openings, the velocity of the gas upon exiting the gas outlet opening and the arch or curvature of the directing surfaces are so chosen that the gas film is formed by the Coanda effect. By the latter, there is exerted through the gas flow in particular a small force in the direction of the gas film on the value document as long as the latter is not located within the gas film, so that an even better stabilization or guidance of the motion of the value document is achieved.

It has turned out to be especially favorable that the distance between the guidance directing surface portions is chosen between 1 mm and 3 mm.

Further, in the method, it is preferred that the ratio of the velocities of the gas in the films averaged over the surface area of the respective gas films and the transport velocity of the value documents in the portion of the transport path is substantially greater than 1, in particular greater than 2.5. Hence, a subject of the invention is also a transport device which is configured for transporting value documents along a transport path, said device having a guiding apparatus according to the invention for a portion of the transport path, and being so configured that the ratio of the velocities of the gas in the films averaged over the surface area of the respective gas films and the transport velocity of the value documents in the portion is preferably substantially greater than 1, in particular greater than 2.5.

Preferably, in the method, the gas films are so formed that they extend over a length of at least 1.5 cm, preferably more than 2 cm, in the transport direction of the value documents. In the apparatus, the film forming device is configured accordingly. The guidance is thus preferably effected in areal fashion.

Furthermore, the apparatus can have a further arched surface which deflects at least one of the gas films, attached to the arched surface, at the end of the portion in which the guidance through the gas films is to be effected or supported, out of the area of the transport path in the direction of a suction device. Preferably, such a deflection is effected with both gas films. This makes it possible for a distribution of dust, which is taken up and transported by the gas films, to be restricted, preferably largely avoided. In the method, at least one of the formed gas films, preferably both, can preferably be deflected in the direction of a suction device by means of an arched surface to which it is attached.

The apparatus according to the invention is suited in particular for use in apparatuses for accepting and/or processing and/or outputting value documents. Hence, a subject of the invention is in particular also an apparatus for accepting and/or processing and/or outputting value documents having an accepting device for accepting value documents, an output device and/or storage device for value documents, and a transport device defining a transport path and configured for transporting value documents from the accepting device to the output device and/or storage device, and an apparatus according to the invention for guiding value documents along a portion of the transport path. As the accepting device the apparatus can have in particular a pocket for a value document stack and a singular for singling value documents from the stack and supplying the singled value documents to the transport device, or a supplying device for individual value documents. The processing of value documents can be understood to be in particular a check, according to respectively specified criteria, for the type of value documents, in the case of bank notes the kind of currency and/or the denomination, their authenticity and/or their state, and/or a sorting in dependence on the check.

In particular, there is preferred an apparatus for accepting and/or processing and/or outputting value documents that further has a checking device for the value documents, which has at least one sensor, arranged on the portion of the transport path, for capturing at least one property of a transported value document and is configured for ascertaining the state and/or the authenticity and/or the type of the value documents according to a specified criterion in dependence on the at least one property.

The gas films formed for guidance permit not only a beltless guidance of the value documents in the area of the sensor, but also keep dust off the latter, so that its functioning is less strongly impaired by dust or other soiling.

If the goal is only to keep the sensor clean, in particular a sensor window extending parallel to the transport path, only one gas film is necessary. The subject of the present invention hence also includes the subjects of the claims, of the description and of the drawings wherein respectively only one gas film is formed, or the guiding device has only one film forming device for a gas film. In particular, a subject of the invention is a method for guiding value documents transported in a specified transport direction along a portion of a transport path wherein there is formed on one side of the transport path portion a film of gas flowing in the transport direction, said film extending at least over the width of the transport path portion and thus the width of value documents transported along the transport path, so that the value document is guided along the gas film. A further subject is an apparatus for guiding a value document along a portion of a transport path in a specified transport direction, having a film forming device which is configured for forming on one side of the transport path portion a film of gas flowing in the transport direction, said film extending at least over the total width of the transport path portion and thus the total width of value documents transported along the transport path, so that the value documents are guided along the gas film. Developments and preferred embodiments result from the preceding description and the claims wherein respectively only one gas film is formed and the film forming device is configured accordingly.

DESCRIPTION OF THE DRAWINGS

The invention will hereinafter be explained further by way of example with reference to the drawings. There are shown.

DETAILED DESCRIPTION OF PREFERRED EMBODIMENTS OF THE INVENTION

Figure 1:
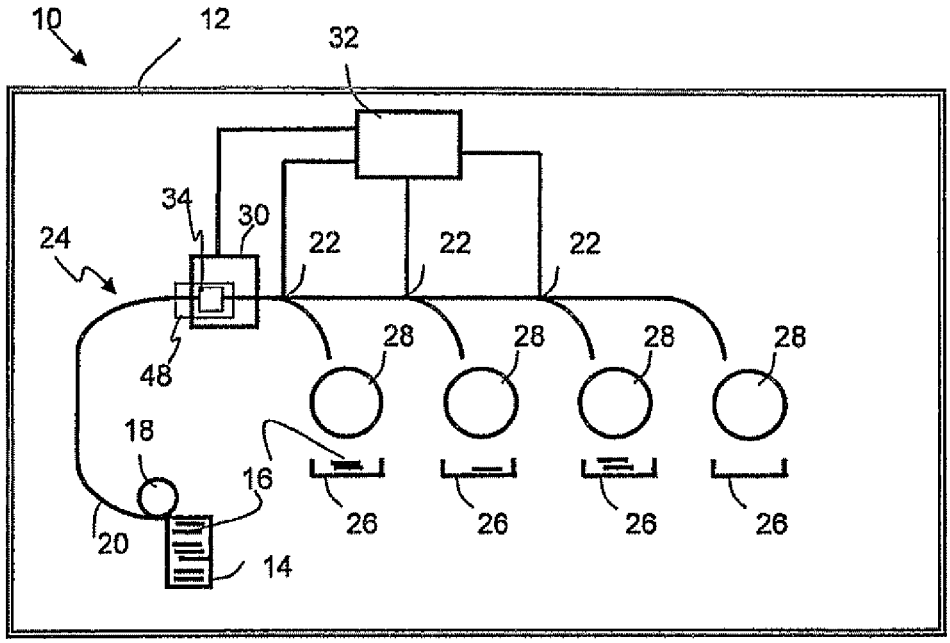
FIG. 1 a schematic view of a value document processing apparatus.

A value document processing apparatus 10 in FIG. 1, in the example a bank-note processing apparatus, has in a housing 12 an input pocket 14 for the input of value documents 16 to be processed, in the example bank notes, a singler 18 which can access value documents 16 in the input pocket 14 and single them, a transport device 20 for transporting the singled value documents with gates 22 and, in branches of a transport path 24 given by the transport device 20, after the gates 22, respective output pockets 26 for receiving value documents processed by means of the value document processing apparatus 10, with stacker wheels 28 arranged therebefore. Further, the bank-note processing apparatus 10 possesses, along the transport path 24 given by the transport device 20, a sensor assembly 30 arranged before the gates 22 for capturing properties of bank notes 16 transported along the transport path 24, as well as a control and evaluation device 32 which is connected at least to the sensor assembly 30 and the gates 22 via signal connections and is configured for evaluating sensor signals of the sensor assembly 30 that reproduce at least one property of a value document 16 captured by the sensor assembly 30, and activating at least one of the gates 22 in dependence on the result of the evaluation of the sensor signals.

The sensor assembly 30 comprises, in this embodiment example, a sensor 34 for capturing optical properties of security features of bank notes, for example specified luminescent substances, and/or of an image of the bank notes, for example for checking for tears, and for ascertaining the denomination of the bank notes. The sensor assembly can further comprise for example an ultrasonic sensor (not shown in FIG. 1) for capturing the state of value documents, for example the presence of adhesive strips, which captures transmission properties of the bank notes for ultrasound.

The control and evaluation device 32 captures the signals of the sensor assembly 30 and checks in this example what denomination a bank note 16 captured by the sensor assembly 30 has, and whether it, according to respectively at least one specified criterion, is in a circulable state, i.e. still suitable for further use as a means of payment, and authentic. In dependence on the result of the check, the control and evaluation device 32 activates at least one of the gates 22 in such a way that the bank note 16 is conveyed by the transport device 20 into an output pocket 26 associated with the check result or corresponding to a certain specified type of bank notes, and stored there.

Figure 2:
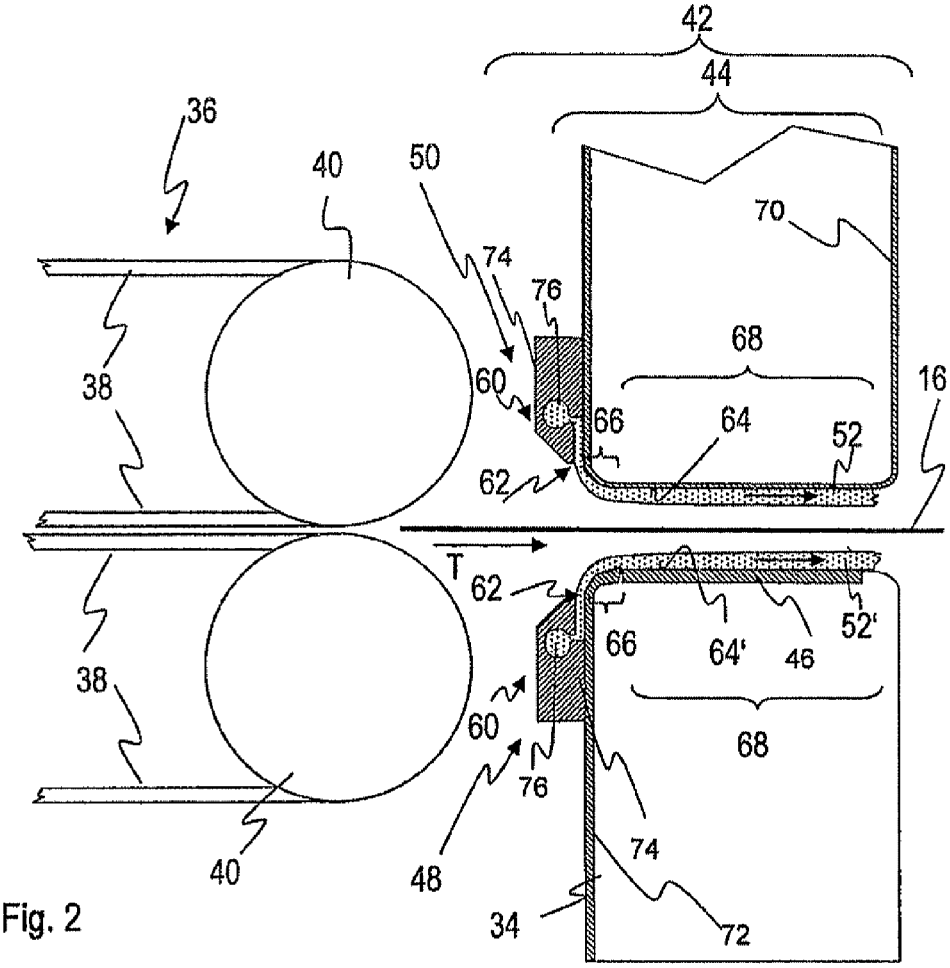
FIG. 2 a schematic partly sectional view of a part of a transport device of the value document processing apparatus in FIG. 1 in the area of a sensor, and FIG. 3 a schematic plan view of a part of the arrangement in FIG. 2 without a belt transport portion.
Figure 3:
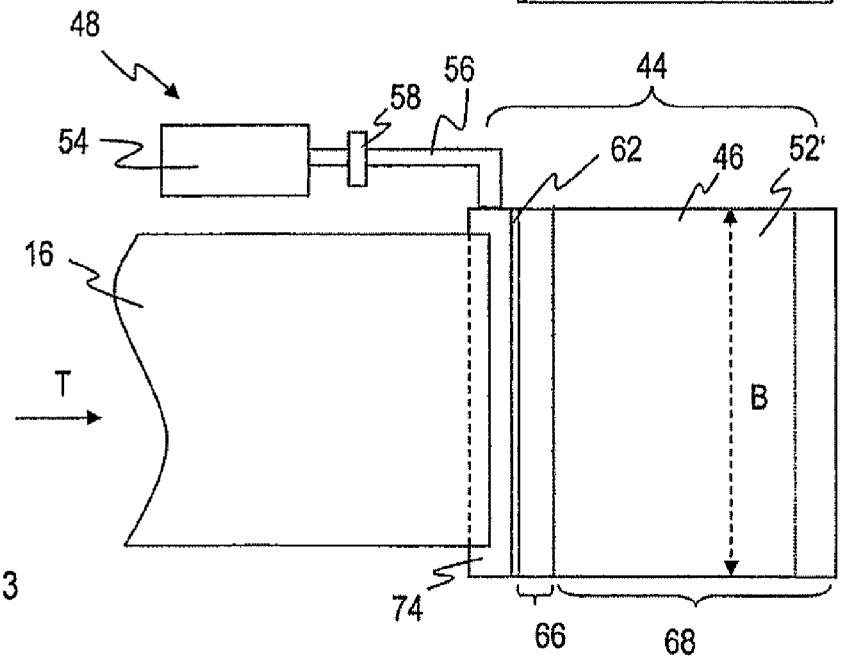

In FIG. 2 there is shown a part of the transport device 20 in the area of the optical sensor 34 which serves to capture luminescence properties of value documents transported past it through its capture area 38 in the transport direction T, shown schematically in a lateral sectional view and in FIG. 3 from above.

The transport device 20 has in the area of the sensor device 30, on the one hand, a belt transport portion 36 which has transport belts 38 and rollers 40. Singled value documents 16 are transported along the transport path 24 in the belt transport portion 36 clamped between the transport belts 38 in a per se known manner. The transport device 20 has, on the other hand, a belt-free transport portion 42 which is directly adjacent to the end of the belt transport portion 36 in the transport direction T, in which a value document exiting from the belt transport portion 36 is guided along a sensor path portion 44 of the transport path 24 without the use of belts or bands. The sensor 34 is arranged on the sensor path portion 44, whereby a sensor window 46, which is transparent to the radiation employed by the sensor 34 and through which radiation employed by means of the sensor 34 for analysis passes, is aligned parallel to the sensor path portion 44.

The transport portion 42 has a guiding apparatus 48 having a film forming device 50 which is configured for respectively forming on mutually opposing sides of the transport path portion or sensor path portion 44 a film 52, 52' of gas flowing in the transport direction T, said film extending at least over the total width of the transport path portion 44 and thus the total width of value documents 16 transported along the transport path, so that the value documents are guided between the gas films 52 and 52'.

The guiding apparatus 48 or the film forming device 50 has for this purpose a gas feeding device 54, supply lines 56 with valves 58 and blowing nozzles 60 with gas outlet openings 62, said nozzles being respectively connected to the gas feeding device 54 by the supply lines 56, and two directing surfaces 64, 64'.

As the gas for guiding the value documents 16, air is employed in the present example. Hence, as the gas feeding device 54 there serves a gas pump which presses ambient air into the supply lines 56 under pressure after filtering.

The gas is respectively supplied through the supply lines 56 to the blowing nozzles 60 from which it exits through the gas outlet openings 62. To be able to mutually coordinate the exit velocities at the gas outlet openings 62, so that the formed films 52 and 52' have substantially same guiding properties, there are provided the valves 58 which are adjusted via a control means in such a way that the exit velocities are mutually coordinated.

The directing surfaces 64 and 64' are in this example identically formed, except for a mirroring with regard to the plane of the transport path portion 44. They have arched deflecting portions 66, respectively adjacent to the gas outlet openings 62, which divert gas flowing out of the gas outlet openings 62, as a film, in a direction parallel to the transport direction T and parallel to guidance directing surface portions 68 extending along the sensor path portion or transport path portion 44.

The directing surfaces 64 and 64' are formed by different directing elements in this embodiment example. On the side opposing the sensor 34 there is provided a directing plate 70 bent in a U shape and having a portion which forms the arched deflecting portion 66 and the guidance directing surface portion 68 which extends parallel to the transport path portion 44 and the sensor window 46.

On the side of the sensor 34 a part of a housing 72 of the sensor 34 and the sensor window 46 of the sensor 34 form the arched deflecting portion 66 and the guidance directing surface portion 68. Housing 72 and the sensor window 46 inserted therein are configured so as to result altogether in a smooth directing surface 64' which makes possible the formation of an attached gas film.

The gas outlet openings 62 and the arched deflecting portions 66 are so configured that gas flows out of the gas outlet openings 62 substantially tangentially to the deflecting portions 66 on the gas outlet openings 62.

Further, the deflecting portions 66, the gas outlet openings 62 and the exit velocities out of the gas outlet openings 62 are mutually coordinated such that the gas flows in the transport direction in the area of the guidance directing surface portions while being attached to the respective directing surfaces 64 and 64' and forms a gas film attached to the directing surfaces 64. In particular, the coordination is chosen such that the Coanda effect is achieved.

The gas films 52, 52' thereby extend over the total width B of the sensor path portion or transport path portion 44.

For forming the gas films with this property the blowing nozzles 60 have the gas outlet openings 62 which are configured in a slot shape, the longitudinal extension or the longer side of the slot extending perpendicular to the transport direction T. Further, the gas outlet openings 62 extend over the total width B of the transport path.

In this example, a simple structure of the blowing nozzles 60 results when they have, as a first element, a portion of the directing plate 70 or of the sensor housing 72 and, as the second element, a basic or gas distribution element 74 identically constructed for both blowing nozzles 60 which is held on the corresponding portion of the first element. The basic or gas distribution element 74 has a gas channel 76 extending perpendicular to the transport direction T or parallel to the longitudinal direction of the gas outlet opening 62 and having connected at one end the respective supply line 56. The gas channel 76 has a slot 78 extending along its longitudinal axis, from which gas can exit. The gas distribution element 74 has on its side facing the first element a recessed portion adjacent to the slot 78, which forms with the first element a nozzle opening into the gas outlet opening 62, through which nozzle the gas is blown out while being attached to the arched deflecting portion 66.

The width of the gas outlet openings 62 lies in this example in the range of 0.04 mm to 0.15 mm, in particular at about 0.1 mm, depending on the exit velocity of the gas.

The distance between the directing surfaces 64 and 64' or the mutually parallel portions of the directing surfaces 64 and 64' preferably lies in the range between 1 mm and 3 mm.

Further, the guiding apparatus is so configured and adjusted that the velocities of the gas of the gas films averaged over the surface area of the films differ by less than 5% and their thicknesses by less than 10%. The resulting gas films preferably have a thickness that is smaller than half the difference of the distance between the guidance directing surface portions 68 of the directing surfaces 64 and the thickness of the value documents. In the example it preferably lies in the range between 0.1 mm and 0.9 mm.

Further, preferably the ratio of the velocities of the gas in the films averaged over the surface area of the respective gas films and the transport velocity of the value documents in the portion preferably lies substantially above 1 and is in particular greater than 2.5.

The gas outlet openings 62 are thus located outside the area of the transport path and cannot impair the transport.

A further advantage of the described arrangement consists in the fact that dust or other soiling is kept away from the sensor window by the gas film, so that it cannot soil so fast.

In other embodiment examples, the belt transport portion can be replaced by a transport portion in which value documents are transported while being clamped between rollers.

Also, it is possible to employ, instead of the sensor 34, a directing element corresponding to the directing plate 70 or a sensor of the component groups on both sides of the transport path.

Also, it is conceivable that the transport path is not planar, but is curved in a plane parallel to the transport direction and orthogonal to the plane of the transported value documents or a tangential plane of the transport path.

If the goal is only to keep the sensor window clean, the gas film that is on top in FIG. 2 is unnecessary. The subject of the present invention hence also includes the subjects of the claims, of the description and of the drawings wherein respectively only one gas film is formed, or the guiding device has only one film forming device for a gas film.

Figure 4:
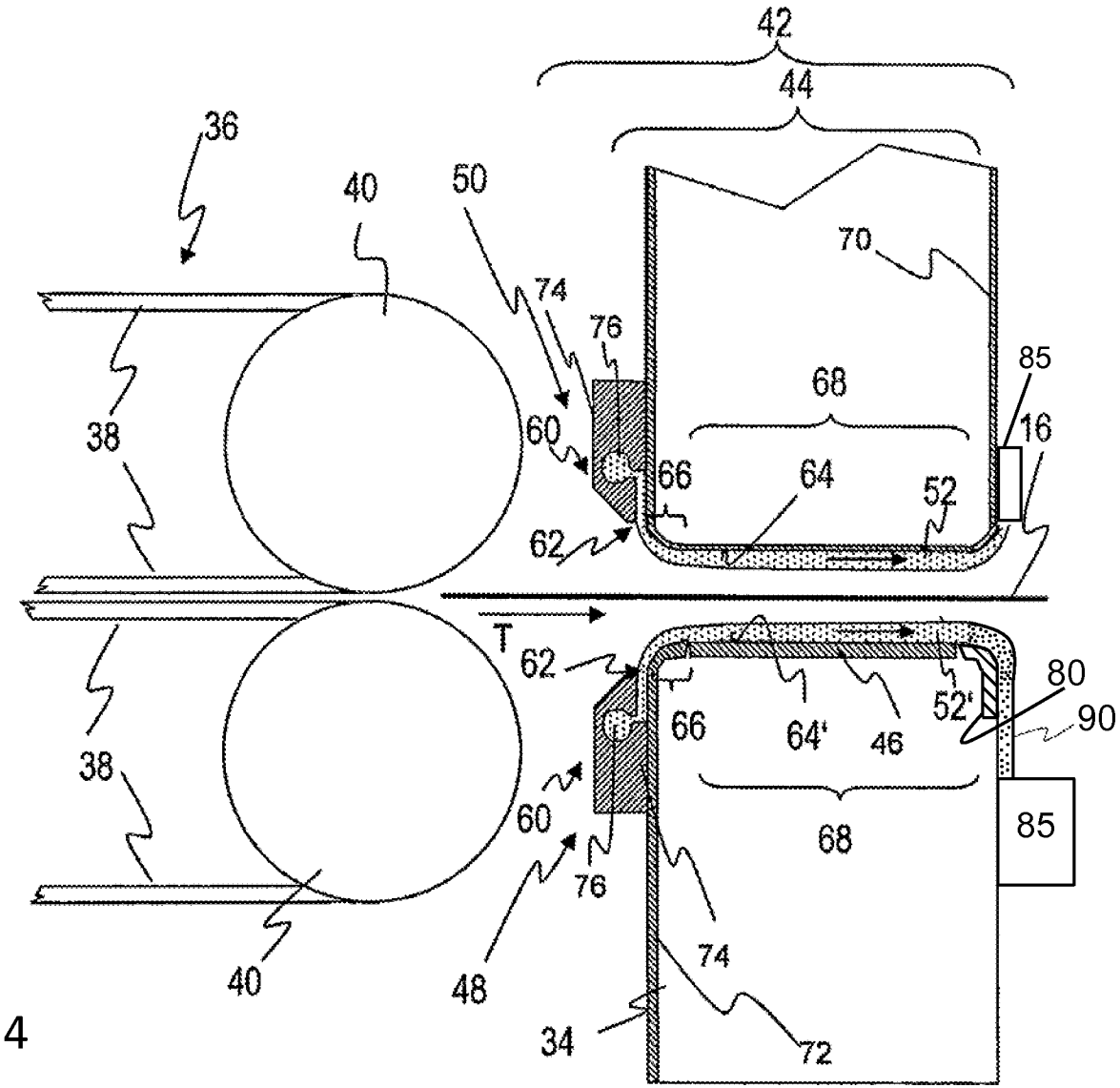

As seen in FIG. 4, a further embodiment example differs from the first embodiment example in that the film forming apparatus can have at the end of the transport path portion 44 on mutually opposing sides of the transport path further arched surfaces 80 which deflect the gas films attached to the arched surface out of the area of the transport path in the direction 90 of suction devices 85. Said further surfaces can be configured similarly to the portions 66, but with a curvature adapted to the then existing velocities of the gas films and curving away from the transport path, regarded in the transport direction. The transport path portion 44 has in this example a length, i.e. extension in the transport direction, of more than 2cm.

The invention claimed is:

1. A method for guiding value documents having a width and being transported along a portion of a transport path in a specified transport direction, comprising the steps:

forming a film of gas flowing in the transport direction on mutually opposing sides of the transport path portion on a directing surface, said film extending at least over a width of the transport path portion and the width of value documents transported along the transport path, so that the value documents are guided between the gas films;

blowing the gas films from a film forming device comprising gas outlet openings for forming the gas in a slot shape extending perpendicular to the transport direction over the width of the transport path portion; and attaching the gas to the directing surfaces by diverting the gas from the gas outlet openings in the transport direction, wherein the gas outlet openings are arranged outside the transport path, and wherein the directing surfaces are arched.

2. The method according to claim 1, further comprising the step:

deflecting the gas films attached to the transport path out of an area of the transport path in a direction of a suction path towards a suction device using a second arched portion.

3. An apparatus for guiding a value document having a width and being transported along a portion of a transport path in a specified transport direction, comprising:

a film forming device which is configured for respectively forming on mutually opposing sides of the transport path portion a film of gas flowing in the transport direction on a directing surface, said film extending at least over a total width of the transport path portion and the total width of value documents transported along the transport path, so that the value documents are guided between the gas films, wherein the film forming device includes gas outlet openings through which the gas is blown out for forming the films and which are configured in a slot shape extending perpendicular to the transport direction over the width of the transport path portion, and wherein the gas outlet openings are arranged outside the transport path, and the directing surfaces have arched portions to which the gas is attached and by which the gas is diverted from the gas outlet openings in the transport direction.

4. The apparatus according to claim 3, wherein the transport path comprises a second arched surface at an end portion of the transport path, said second arched surface configured to deflect the gas films attached to the transport path out of an area of the transport path in a direction of a suction path.

5. The apparatus according to claim 4, further comprising a suction device arranged to receive the gas films from the suction path.

6. The apparatus according to claim 3, wherein the film forming device is configured to form the films of gas having a velocity averaged over a surface area of the films of gas that differs by less than 5% and said films have a thickness that differs less than 10% along the transport path.

7. An apparatus for accepting and/or processing and/or outputting value documents, comprising an accepting device for accepting value documents, an output device and/or storage device for value documents, a transport device defining a transport path and being configured for transporting value documents from the accepting device to the output device and/or storage device, and an apparatus for guiding a value document having a width and being transported along a portion of a transport path in a specified transport direction, comprising a film forming device which is configured for respectively forming on mutually opposing sides of the transport path portion a film of gas flowing in the transport direction, said film extending at least over a total width of the transport path portion and the total width of value documents transported along the transport path, so that the value documents are guided between the gas films, wherein the film forming device includes gas outlet openings through which the gas is blown out for forming the films and which are configured in a slot shape extending perpendicular to the transport direction over the width of the transport path portion, and a checking device for the value documents comprising at least one sensor, arranged on the portion of the transport path, arranged to capture at least one property of a transported value document and which is configured to determine the state and/or the authenticity and/or the type of the value documents according to a specified criterion in dependence on the at least one property.

8. The apparatus according to claim 7, wherein the film forming device includes two mutually opposing directing surfaces between which the transport path is located, wherein said gas outlet openings through which the gas is blown out are configured so that the films are formed as films attached to the directing surfaces.

9. The apparatus according to claim 7, wherein the transport path comprises an arched surface at an end portion of the transport path, said arched surface configured to deflect the gas films attached to the transport path out of an area of the transport path in a direction of a suction path.

10. The apparatus according to claim 9, further comprising a suction device arranged to receive the gas films from the suction path.

* * * * *